US008342252B2

(12) United States Patent
Alzemi

(10) Patent No.: US 8,342,252 B2
(45) Date of Patent: Jan. 1, 2013

(54) AUTOMATIC FIRE EXTINGUISHER

(76) Inventor: Mohammad Abdullah Alzemi, Mubarak Alkabeer (KW)

( * ) Notice: Subject to any disclaimer, the term of this patent is extended or adjusted under 35 U.S.C. 154(b) by 281 days.

(21) Appl. No.: 12/411,876

(22) Filed: Mar. 26, 2009

(65) Prior Publication Data

US 2010/0243279 A1 Sep. 30, 2010

(51) Int. Cl.
*B05B 12/14* (2006.01)

(52) U.S. Cl. ..... 169/26; 169/36; 169/42; 169/71; 169/89

(58) Field of Classification Search ..... 169/36, 169/42, 71, 72, 89; 239/352, 354, 338, 339, 239/373, 26
See application file for complete search history.

(56) References Cited

U.S. PATENT DOCUMENTS

| | | | | |
|---|---|---|---|---|
| 3,092,183 | A * | 6/1963 | Guise et al. | 169/74 |
| 3,638,733 | A * | 2/1972 | De Rouville et al. | 169/19 |
| 4,197,915 | A * | 4/1980 | Martin | 169/72 |
| 4,718,498 | A | 1/1988 | Davios et al. | |
| 5,458,201 | A | 10/1995 | Brim | |
| 5,613,564 | A | 3/1997 | Rhines | |
| 5,771,977 | A | 6/1998 | Schmidt | |

* cited by examiner

*Primary Examiner* — Christopher Kim
(74) *Attorney, Agent, or Firm* — Lowe Hauptman Ham & Berner, LLP

(57) ABSTRACT

An automatic fire extinguisher includes a closed metal container with a top and upper portion in the shape of the frustum of a cone, a hemispherical shaped lower portion and a weighted bottom portion. The closed container includes a closeable opening for filling the container with the fire suppressant and a pressure valve for pressurizing the container after filling with suppressant. A quantity of fire suppressant is disposed in the container and dischargeable through a tubular member that extends through the top of the container and outwardly through a spray nozzle attached to the tubular member.

1 Claim, 2 Drawing Sheets

AUTOMATIC FIRE EXTINGUISHER

FIELD OF THE INVENTION

This invention relates to an automatic fire extinguisher and more particularly to an automatic fire extinguisher that is activated by an elevated temperature.

BACKGROUND FOR THE INVENTION

Automatic fire extinguishers are well known and have been in use for many years. For example a U.S. Patent of Davios et al., U.S. Pat. No. 4,718,498 discloses a flame sensing device connected to a supply of electric current to an electromagnet to release the fire extinguishing fluid to extinguish a fire. The flame sensing device includes a first spring which extends when heated, and a second spring in compression acting to pull an end of the first spring to close a contact to thereby provide electric current to the electromagnet.

A more recent patent of Brim, U.S. Pat. No. 5,458,201 discloses an adapter for a fire extinguisher that is mountable to a valve assembly of a conventional fire extinguisher to form a portable automatic fire extinguisher. The adapter comprises a coupling which is mountable to the valve assembly, an elongate conduit and an automatic sprinkler head. When the adapter is mounted to the fire extinguisher the sprinkler head is placed in fluid communication with the fire extinguisher and is locatable adjacent a ceiling of a room. If a fire occurs in the room the automatic sprinkler head releases fluid from the fire extinguisher onto the floor of the room.

A still further approach to automatic fire extinguishers is disclosed in a United States Patent of Schmidt, U.S. Pat. No. 5,771,977. The Schmidt patent discloses an adapter to a trigger mechanism of a conventional fire extinguisher to form a portable automatic fire extinguisher. The adapter comprises a compressed spring held in place with a heat release fusible link. If a fire occurs in the vicinity of the adapter, the fusible link separates allowing the compression spring to depress the fire extinguisher trigger mechanism.

Notwithstanding the above it is presently believed that there may be a need and a potential commercial market for an automatic fire extinguisher in accordance with the present invention. There may be a need and a commercial market because such extinguishers have a relative simple design, should be relatively inexpensive to manufacture and sell, durable and relatively easily to refill and recharge. In addition, the automatic fire extinguisher in accordance with the present invention is self-righting and heat activatible.

BRIEF SUMMARY OF THE INVENTION

In essence the present invention contemplates an automatic fire extinguisher comprising and/or consisting of a generally bulb shaped closed container having a top, an upper portion in the shape of a frustum of a cone, a hemispherical shaped lower portion and a weighted bottom portion. A quantity of fire extinguishing fluid is disposed in the lower portion of the closed container and a tubular member having an upper portion and a lower portion with the upper portion extending through the top of the closed container and a lower portion of the tubular member extending downwardly into the lower portion of the closed container. In addition the fire extinguisher includes a heat activatible valve closes the tubular member until actuated by a temperature in excess of 68° C. (155° F.) and thereafter dispensing the fire extinguishing fluid through the top of the container and into or onto a fire.

In a preferred embodiment of the invention, the fire extinguisher also includes a weighted bottom portion for positioning and maintaining the container in an upright position and a closeable opening for filling or refilling the closed container with a liquid fire extinguishing fluid. The closeable opening also includes a seal for sealing the closed opening. Further, the extinguisher includes means for pressurizing the closed container after filling or refilling the container with a liquid fire suppressant. An added feature includes a spray nozzle and a heat activatible mercury valve closing. The valve closes the tubular member until activated by an elevated temperature. The spray nozzle is constructed and arranged to receive fire extinguishing fluid from the closed container and to spray the fluid into a fire when the heat activable valve is activated by the elevated temperature.

The invention will now be described in connection with the accompanying drawings wherein like reference numerals have been used to indicate like parts

DESCRIPTION OF THE PREFERRED EMBODIMENTS OF THE INVENTION

Figure 1:
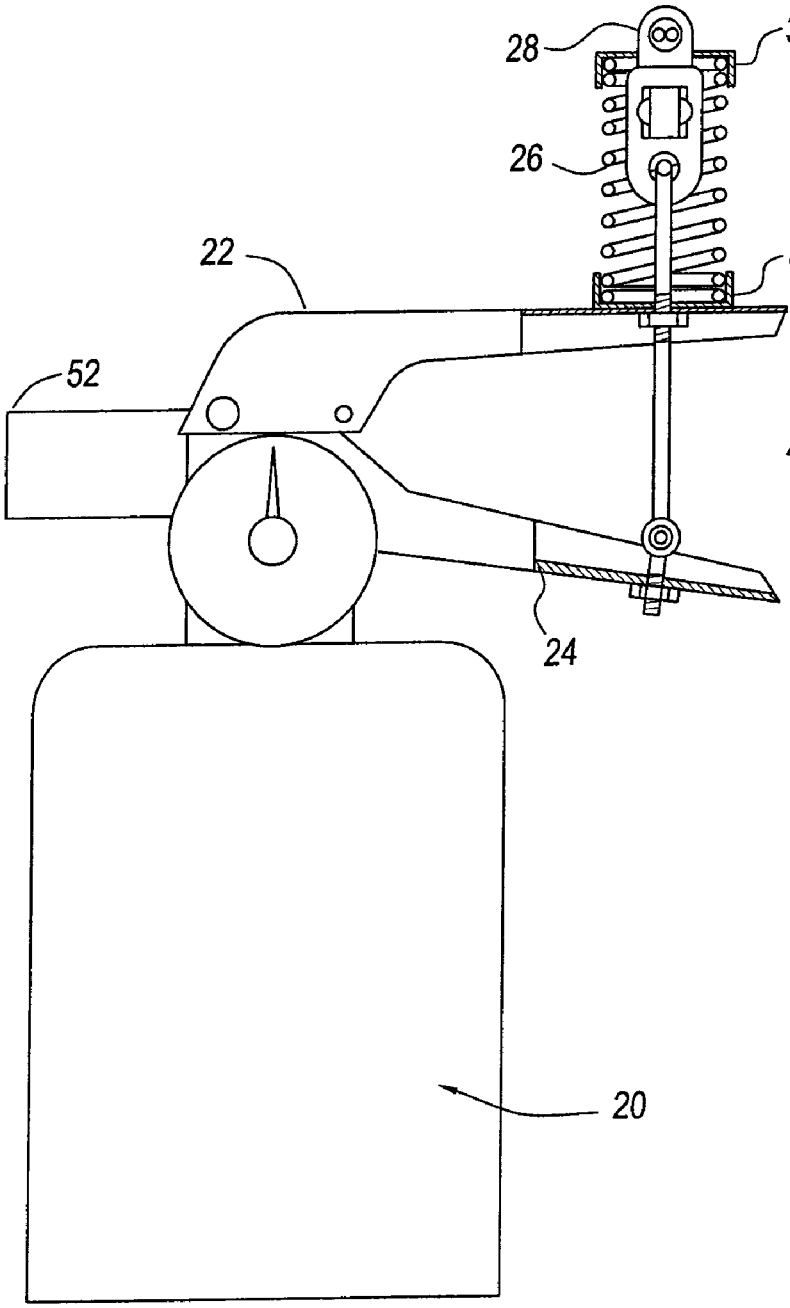
FIG. 1 PRIOR ART
FIG. 1 is a side elevational view partially cutaway of a hand held fire extinguisher with an adapter according to a prior art automatic fire extinguisher.
Figure 2:
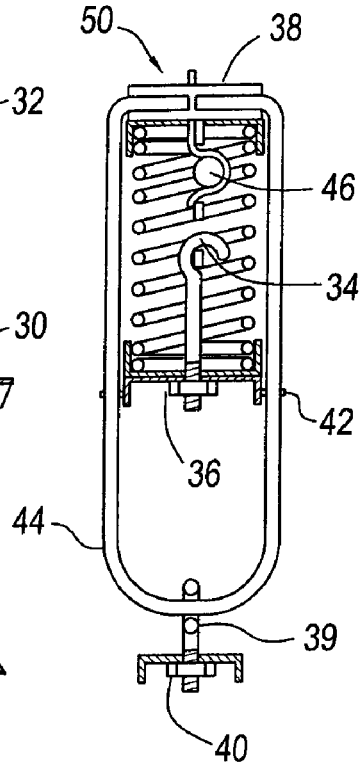
FIG. 2 PRIOR ART
FIG. 2 is a side elevational view of the adapter shown in FIG. 1 but with the spring under compression and held in place by a fusible link.

A prior art automatic fire extinguisher adapter is illustrated in FIGS. 1 and 2. As shown, a fire extinguisher adapter 50 in accordance with the prior art is mountable to a portable hand held fire extinguisher 20 to create a portable automatic fire extinguisher assembly.

The adapter 50 comprises a spring 26, a heat release fusible link 28, a spring bottom cap 30, a spring top cap 32, a retention tube 38 and a hook bolt 34 that is attached to the movable trigger arm 22 of the fire extinguisher 20. A nut 36 is used to retain the hook bolt 34 to the trigger arm 22. The adapter is made of materials that are capable of withstanding fire for the time required to activate the heat sensitive coupling 46.

A coupling wire 44 is used to connect the top of the heat release fusible link 28 to the stationary arm 24 of the fire extinguisher 20. An eyelet bolt 39 is connected to the stationary arm 24 by a nut 40. The coupling wire 44 is attached to the eyelet bolt 39. The coupling wire 44 is held in place by the movable trigger arm 22 with two guides 42. The guides 42 keep the spring 26 from cocking when the fusible link 28 releases. When the fire extinguisher adapter 50 is exposed to fire, the heat sensitive coupling 46 melts at a predetermined temperature and the fusible link 28 separates from the load of the spring 26. The spring 26 uncompresses and forces the movable trigger 22 against the stationary trigger 24. This causes the fire extinguisher 20 to discharge its contents out of the nozzle 52.

Figure 3:
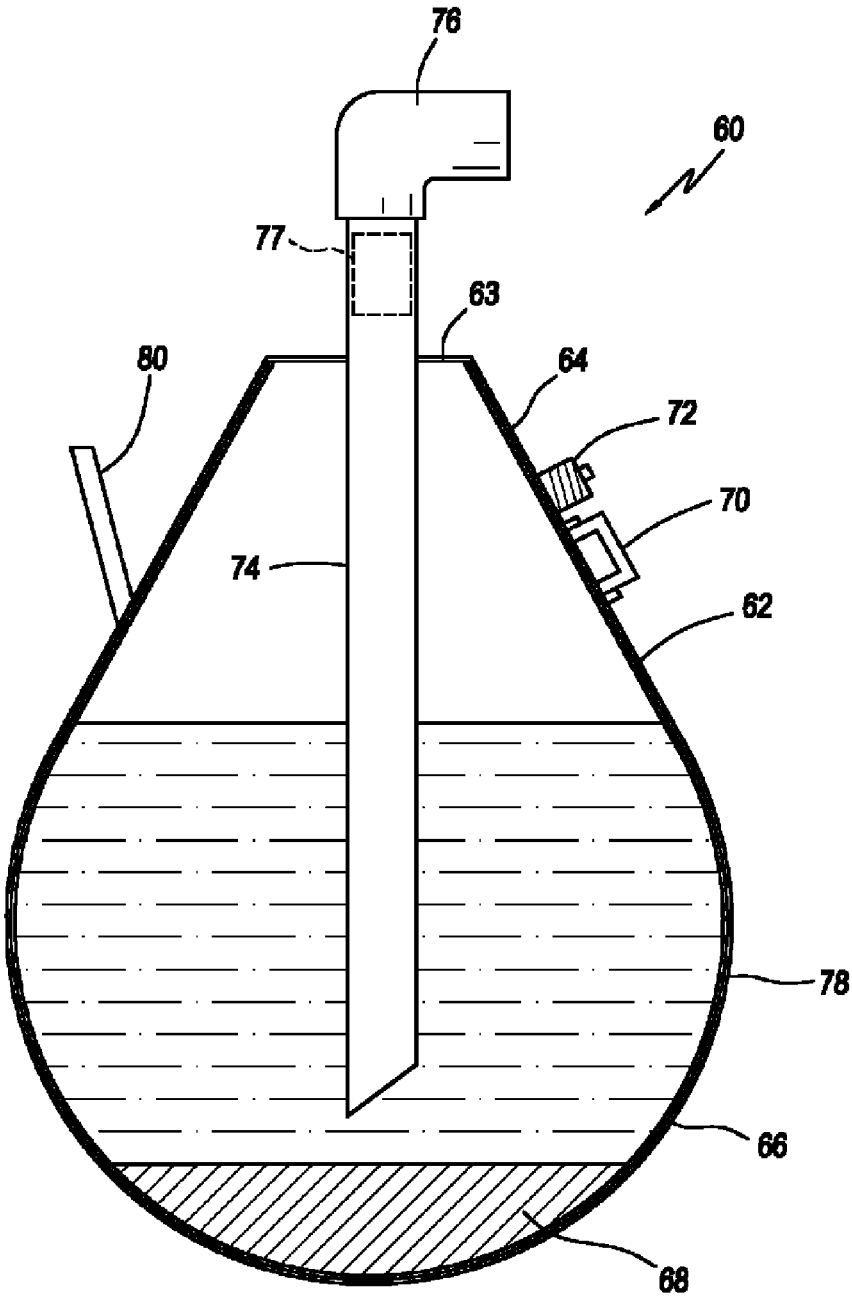
FIG. 3 is a schematic view of an automatic fire extinguisher in accordance with the present invention.

As shown in FIG. 3, an automatic fire extinguisher in accordance with the present invention has a shape that is generally similar to a conventional light bulb with an enlarged portion surrounding the filaments and a constricted end that tapers down to a socket. To be more specific, in the present case an automatic fire extinguisher 60 includes a generally bulb shaped closed container 62 having a generally flat top 63 and an upper portion 64 having the shape of a frustum of a cone. A hemispherical shaped lower portion 66 positions and maintains the position of the container in an upright position as the result of a weighted bottom 68.

In a preferred embodiment of the invention, the closed container includes a closable opening 70 for filling or refilling the closed container with a liquid fire extinguishing fluid and a seal for sealing the closable opening after filling. Means 72 are also provided for pressurizing the closed container after filling or refilling the closed container with a liquid fire suppressant and wherein the closable opening and the means for pressurizing the closable container are disposed in an upper portion 64 of the closed container 62.

As provided in all of the embodiments of the present invention a quantity of fire extinguishing fluid is disposed in the lower portion of the closed container and may extend upwardly into the upper portion 64 of the container 62.

In this embodiment of the invention a tubular member 74 having an upper portion and lower portion extends through the top 63 of the closed container while a lower portion of the tubular member extends downwardly into the lower portion of the closed container and into the supply of liquid fire extinguishing fluid near the bottom of the closed container.

A conventional spray nozzle 76 and a heat activatible mercury valve 77 closes the tubular member and upward portion thereof until activated by a temperature of at least 68° C. (155° F.). The spray nozzle is constructed and arranged to receive fire extinguishing fluid from the closed container when the heat activatible valve is opened and then to spray fluid onto or into a fire. Finally, the fire extinguisher includes a handle 80 on one side of the closed container.

An automatic fire extinguisher in accordance with the present invention can be placed in an area that is susceptible to incineration or at times placed next to and adjacent to a fire. At other times the fire extinguisher may be thrown into the fire. Therefore, in a preferred embodiment of the invention, the fire extinguisher is made of metal which will resist temperatures of 600° C. to 1,000° C. and/or may be coated with a heat resistant paint 78 that will resist temperatures of up to 1500° C.

Further, when using a sprinkler, a conventional sprinkler head that is presently available on the market may be used together with a fire suppressant such as water, flowable dry powder, etc. as will be well understood by persons of ordinary skill in the art.

Finally, the fire extinguisher in accordance with the present invention are particularly applicable for small areas that are difficult to reach as well in heavily wooded areas with excessive growth of underbrush.

While the invention has been disclosed in connection with its preferred embodiments it should be recognized that changes and modifications may be made therein without departing from the scope of the claims.

What is claimed is:

1. An automatic fire extinguisher, consisting of:

a generally bulbous closed metal container having a flat top, an upper portion in the shape of a frustum of a cone, a hemispherical shaped bottom portion consisting of a hemispherical shaped weight having a flat upper surface disposed within said hemispherical bottom portion for balancing and positioning said automatic fire extinguisher in an upright position;

a quantity of fire extinguishing fluid disposed in said bottom portion of said bulbous closed container and extending upwardly into the upper portion thereof;

a closeable opening in said upper portion of said closed container for filling and refilling said closed container with liquid fire extinguishing fluid;

means for pressurizing said closed container after filling or refilling said closed container with liquid fire extinguishing fluid;

a tubular member having an upper portion and a lower portion with said upper portion extending through said top of said closed container and a lower portion of said tubular member extending downwardly into said lower portion of said closed container and into said fire extinguishing fluid;

a spray nozzle and a heat activatible mercury valve closing said tubular member until activated by a temperature in excess of 68° C. (155° F.) and thereafter dispensing said fire extinguishing fluid through said top of said container and said spray nozzle into or onto a fire; and said bulb shaped closed metal container is coated with a heat resistant paint that will resist temperatures of up to 1500° C.

* * * * *